US007841484B2

(12) United States Patent
Kaneko et al.

(10) Patent No.: US 7,841,484 B2
(45) Date of Patent: Nov. 30, 2010

(54) CAPPED CONTAINER

(75) Inventors: Masamichi Kaneko, Tokyo (JP); Hiroyuki Serizawa, Tokyo (JP)

(73) Assignee: Tetra Laval Holdings & Finance S.A., Pully (CH)

( * ) Notice: Subject to any disclaimer, the term of this patent is extended or adjusted under 35 U.S.C. 154(b) by 861 days.

(21) Appl. No.: 11/662,607

(22) PCT Filed: Sep. 30, 2004

(86) PCT No.: PCT/JP2004/014333

§ 371 (c)(1),
(2), (4) Date: Mar. 13, 2007

(87) PCT Pub. No.: WO2006/038251

PCT Pub. Date: Apr. 13, 2006

(65) Prior Publication Data

US 2007/0289937 A1 Dec. 20, 2007

(51) Int. Cl.
*B65D 17/42* (2006.01)

(52) U.S. Cl. ..... 220/277; 220/258.4; 215/297; 222/83; 408/206; 83/30; 83/946

(58) Field of Classification Search ..... 220/267, 220/277, 297, 258.4; 215/297; 83/30, 946; 408/204, 206; 222/83
See application file for complete search history.

(56) References Cited

U.S. PATENT DOCUMENTS 5,325,983 A * 7/1994 Imai et al. ..... 220/277
5,482,176 A * 1/1996 Maietta et al. ..... 220/277
6,223,924 B1 * 5/2001 Ek et al. ..... 220/258.4
6,422,412 B1 * 7/2002 Sagawa ..... 220/277
6,851,576 B2 * 2/2005 Dubach ..... 222/83
7,540,405 B2 * 6/2009 Sase et al. ..... 229/125.14
2002/0179605 A1 12/2002 Miani et al. ..... 220/277
2005/0242113 A1 11/2005 Weist ..... 222/83.5
2006/0261028 A1 * 11/2006 Dubach ..... 215/257
2009/0302037 A1 * 12/2009 Rigling ..... 220/258.4

FOREIGN PATENT DOCUMENTS

JP 2001-106248 4/2001
JP 2003-26219 1/2003
WO WO 2004/022437 3/2004

* cited by examiner

*Primary Examiner*—Anthony Stachick
*Assistant Examiner*—James N Smalley
(74) *Attorney, Agent, or Firm*—Bacon & Thomas, PLLC

(57) ABSTRACT

There is provided a capped container in which the angle of rotation of a screw cap required for unsealing the same can be rendered small and in which a cut piece can be prevented from being completely cut away from a container body. The capped container includes a container body (11) including a wall portion and a rupture portion (36) formed at a predetermined position of the wall portion; a tubular base portion attached to the wall portion and surrounding the rupture portion (36); a movable tube (16) disposed in the base portion and thread-engaged with the base portion; and a screw cap (17) disposed outside the base portion, thread-engaged with the base portion, engaged with the movable tube (16), and adapted to rotate the movable tube (16) while being rotated. A cutting member (38) including a plurality of blades (t1 to t6) and adapted to cut the rupture portion (36) as the screw cap (17) is rotated is formed at a lower end of the movable tube (16). A bottom portion (br) is formed between pointed tips (p1 and p6) of two predetermined blades (t1 and t6).

6 Claims, 11 Drawing Sheets

CAPPED CONTAINER

TECHNICAL FIELD

The present invention relates to a capped container.

BACKGROUND ART

Conventionally, a capped container in which a cap is attached to a container body has been provided.

FIG. 1 is a sectional view of a main portion of a conventional capped container.

As shown in FIG. 1, a cap Cp is attached to a top wall of a container body 11, and the container body 11 and the cap Cp constitute a capped container. The cap Cp includes a base flange 15; a movable tube 16, which is disposed in the base flange 15 rotatably and in a reciprocatory condition (in FIG. 1, in a vertically movable condition); and a screw cap 17, which is disposed outside the base flange 15 rotatably and in a reciprocatory condition.

At the time of unsealing the capped container, a rupture portion 12 formed on the top wall of the container body 11 is cut to thereby form an outlet 11A. The base flange 15, which includes a lower flange portion 13 and an upper tubular portion 14 formed integrally with the flange portion 13, is fixedly attached along an upper peripheral edge of the rupture portion 12.

In the tubular portion 14, a female thread 14A is formed on the inner surface in a region extending from substantially the vertical center to the lower end, and a male thread 14B is formed on the outer surface in a region extending from substantially the vertical center to the upper end. In the movable tube 16, a plurality of ribs 16A are formed on the inner surface at predetermined circumferential pitches and in a vertically extending condition, and a male thread 16B is formed on the outer surface. A single pointed tip portion 18 for cutting the rupture portion 12 is formed at the lower end of the movable tube 16 at a predetermined circumferential position in a downward projecting condition.

The screw cap 17 includes a top wall 21, and a side wall 22 extending downward from the peripheral edge of the top wall 21. A female thread 22A is formed on the inner surface of the side wall 22. In the screw cap 17, a plurality of arms 23 are formed at predetermined positions located radially inward of the side wall 22 in such a manner as to extend downward from the top wall 21 and at the same pitches as those of the ribs 16A so as to correspond to the ribs 16A. In each of the arms 23, a longitudinally extending engagement piece 24 is formed on the radially outward surface at the lateral center, and a rib 25 is formed on the radially inward surface at the lateral center in such a manner as to extend from substantially the longitudinal center to the upper end.

The tubular portion 14 and the movable tube 16 are thread-engaged with each other by means of the female thread 14A and the male thread 16B; the tubular portion 14 and the side wall 22 are thread-engaged with each other by means of the male thread 14B and the female thread 22A; and the movable tube 16 and the arms 23 are engaged together by means of the ribs 16A and the corresponding engagement pieces 24. Notably, the female thread 14A and the male thread 16B are inverse in helix to the male thread 14B and the female thread 22A. In other words, the female thread 14A and the male thread 16B are right-handed threads, whereas the male thread 14B and the female thread 22A are left-handed threads.

Accordingly, in the initial state of the cap Cp, rotating the screw cap 17 in the tightening direction causes the screw cap 17 to move downward, since the tubular portion 14 and the side wall 22 are thread-engaged. In association with this, the arms 23 are caused to move downward, so that the ribs 16A and the corresponding engagement pieces 24 are engaged with each other. Subsequently, as the screw cap 17 is rotated, the movable tube 16 is caused to rotate in the same direction. In this case, since the tubular portion 14 and the movable tube 16 are thread-engaged, the movable tube 16 is caused to move upward while being rotated.

Meanwhile, when the screw cap 17 is rotated in the loosening direction, the screw cap 17 is moved upward. In association with this, the arms 23 are moved upward while the ribs 16A and the corresponding engagement pieces 24 are engaged with each other, so that the movable tube 16 is rotated in the same direction. As the movable tube 16 is rotated, the movable tube 16 is caused to move downward, so that the pointed tip portion 18 cuts the rupture portion 12 to thereby unseal the capped container (refer to, for example, Patent Document 1).

Patent Document 1: Japanese Patent Application Laid-Open (kokai) No. 2001-106248

DISCLOSURE OF THE INVENTION

Problems to be Solved by the Invention

In the above-mentioned capped container, when the pointed tip portion 18 is rotated about the centerline by about 270[°], a portion of the peripheral edge of the rupture portion 12 corresponding to about 270[°] is cut from the container body 11, so that a portion of the rupture portion 12 which is located radially inward of the peripheral edge of the rupture portion 12; i.e., a cut piece, is pressed downward into the container body 11. In this manner, the outlet 11A is opened. Therefore, the pointed tip portion 18 must be rotated by about 270[°] before the unsealing operation is completed; in other words, the screw cap 17 must be rotated by a large angle in order to unseal the capped container.

Also, if the pointed tip portion 18 is rotated while being tangled with the cut piece, the cut piece will be completely cut away from the container body 11 to drop into the capped container.

An object of the present invention is to solve the above-mentioned problem in the conventional capped container and to provide a capped container in which the angle of rotation of a screw cap required for unsealing the same can be rendered small and in which a cut piece can be prevented from being completely cut away from a container body.

Means for Solving the Problems

To achieve the above object, a capped container of the present invention comprises a container body including a wall portion, a cap attachment portion provided at a predetermined position of the wall portion and adapted to attach a cap thereto, and a rupture portion formed at the cap attachment portion; a tubular base portion attached to the wall portion and surrounding the rupture portion; a movable tube disposed in the base portion and thread-engaged with the base portion; and a screw cap disposed outside the base portion, thread-engaged with the base portion, engaged with the movable tube, and adapted to rotate the movable tube while being rotated.

A cutting member including a plurality of blades and adapted to cut the rupture portion as the screw cap is rotated is formed at the lower end of the movable tube. A bottom portion is formed between pointed tips of two predetermined blades.

In another capped container of the present invention, the bottom portion is formed over a range wider than a reference interval between pointed tips of blades.

In still another capped container of the present invention, the bottom portion is formed between the pointed tip of a first blade and the pointed tip of a last blade.

In yet another capped container of the present invention, in addition to the bottom portion, one or more auxiliary bottom portions are each formed in a range equal to or less than the reference interval between pointed tips of blades.

In still another capped container of the present invention, the bottom portion is formed wider in span than the auxiliary bottom portion or the auxiliary bottom portions.

In a further capped container of the present invention, the first blade differs in shape from other blades.

In a further capped container of the present invention, the depth of a leading cutting edge of the first blade is equal to a distance of downward movement of the movable tube as measured when the movable tube is rotated by the reference interval between pointed tips of blades.

Effects of the Invention

According to the present invention, the capped container comprises a container body including a wall portion, a cap attachment portion provided at a predetermined position of the wall portion and adapted to attach a cap thereto, and a rupture portion formed at the cap attachment portion; a tubular base portion attached to the wall portion and surrounding the rupture portion; a movable tube disposed in the base portion and thread-engaged with the base portion; and a screw cap disposed outside the base portion, thread-engaged with the base portion, engaged with the movable tube, and adapted to rotate the movable tube while being rotated.

A cutting member including a plurality of blades and adapted to cut the rupture portion as the screw cap is rotated is formed at the lower end of the movable tube. A bottom portion is formed between pointed tips of two predetermined blades.

In this case, since the cutting member including the plurality of blades and adapted to cut the rupture portion as the screw cap is rotated is formed at the lower end of the movable tube, the angle of rotation of the screw cap required for unsealing the capped container can be rendered small.

Since a bottom portion is formed between pointed tips of two predetermined blades, a cut piece can be prevented from being completely cut away from a container body.

DESCRIPTION OF REFERENCE NUMERALS

Figure 1:
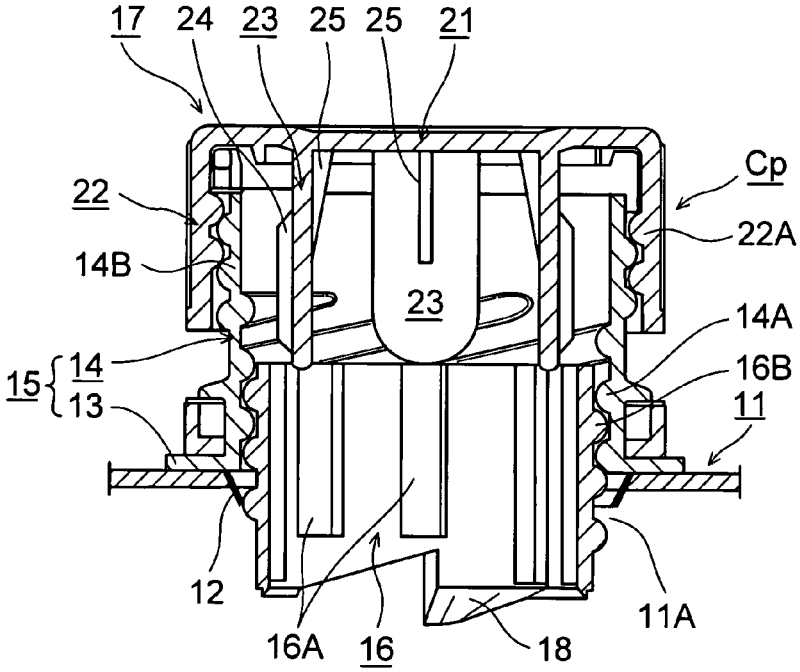
FIG. 1 PRIOR ART
[FIG. 1] Sectional view showing a main portion of a conventional capped container.

11: container body
15: base flange
16: movable tube
17: screw cap
31: capped container
36: rupture portion
38: cutting member
51: leading cutting edge
br: bottom portion
br1, br11: first bottom portion
br2, br12: second bottom portion
Cp: cap
e: top wall
Q: cap attachment portion
t1-t6, t11-t16, t21-t25: blade

BEST MODE FOR CARRYING OUT THE INVENTION

Embodiments of the present invention will next be described in detail with reference to the drawings.

Figure 2:
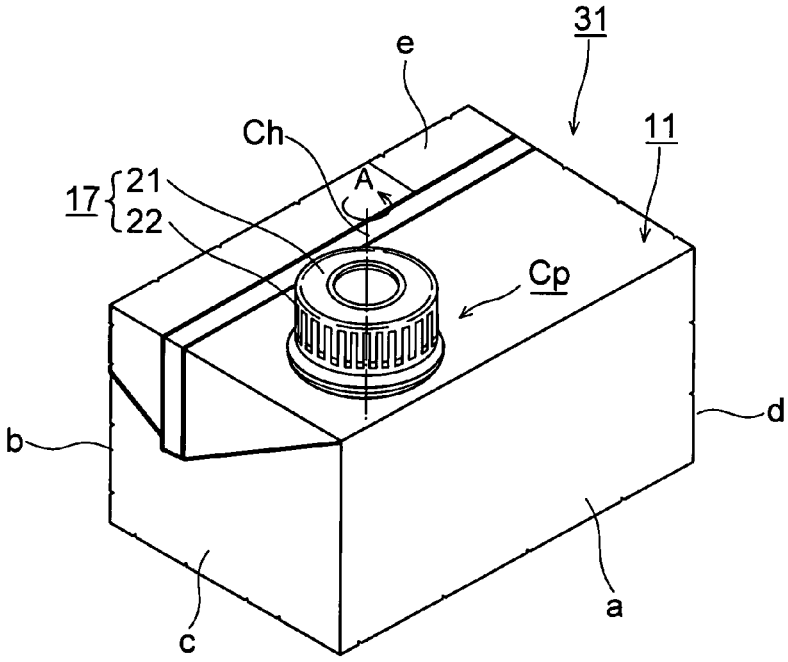
[FIG. 2] Perspective view showing a main portion of a capped container according to a first embodiment of the present invention.
Figure 3:
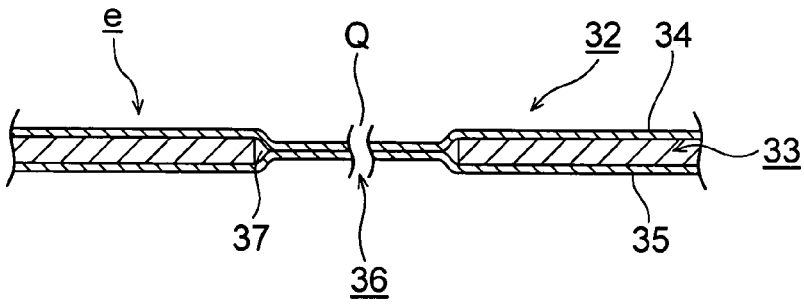
[FIG. 3] Sectional view showing a main portion of a top wall in the first embodiment of the present invention.

FIG. 2 is a perspective view showing a main portion of a capped container according to a first embodiment of the present invention; FIG. 3 is a sectional view showing a main portion of a top wall in the first embodiment of the present invention; and FIG. 4 is an exploded view of a cap in the first embodiment of the present invention.

Figure 4:
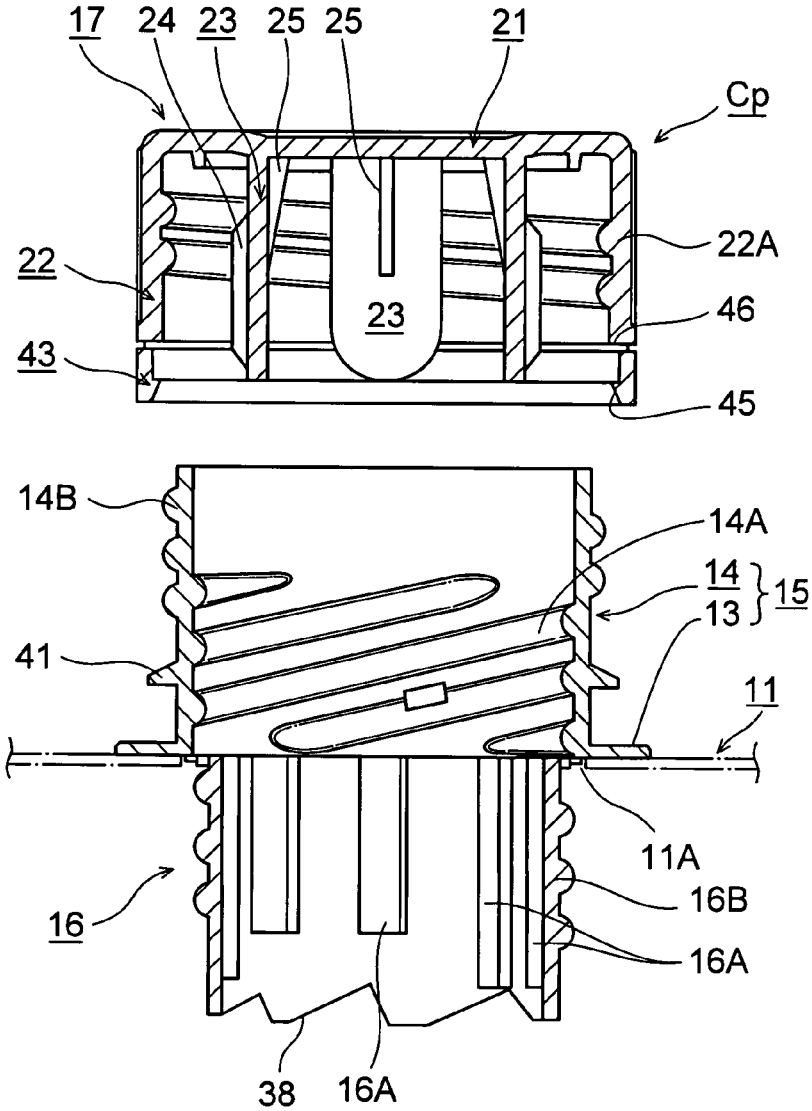
[FIG. 4] Exploded view of a cap in the first embodiment of the present invention.

In FIGS. 2 to 4, reference numeral 31 denotes a capped container for containing, as the contents thereof, liquid food, which serves as food having fluidity; i.e., fluid food. The capped container 31 includes a container body 11 and a cap Cp. The container body 11 is formed from a packaging material 32 and formed into substantially the shape of a rectangular parallelepiped. The container body 11 includes a wall portion; specifically, a front wall a, a rear wall b, two side walls c and d, a top wall e, and an unillustrated bottom wall. The packaging material 32 assumes a laminated structure that includes a paper substrate 33; a first resin film 34 formed from polyethylene resin or the like and covering the paper substrate 33 to thereby serve as an outermost layer; and a second resin film 35 formed from polyethylene resin or the like and covering the paper substrate 33 to thereby serve as an innermost layer. If necessary, an unillustrated barrier layer having a gas barrier property is formed adjacent to the paper substrate 33.

A cap attachment portion Q is provided at a predetermined position on the top wall e; a rupture portion 36 is formed at the cap attachment portion Q; and when the capped container 31 is unsealed, the rupture portion 36 is cut to thereby become an outlet 11A through which liquid is poured out. The rupture portion 36 is formed as follows: in the course of formation of the packaging material 32, a punched hole 37 is formed in the paper substrate 33 at a predetermined position, and then the first and second resin films 34 and 35 are joined by fusion into a thin-walled portion that serves as the rupture portion 36. Alternatively, the rupture portion 36 may be formed as follows: perforations are formed in the paper substrate 33 along the outlet 11A, and then the paper substrate 33 is covered with the first and second resin films 34 and 35.

The cap Cp is formed from resin, and includes a base flange 15, which is attached to the top wall e while surrounding the rupture portion 36 and serves as a substantially tubular base portion; a movable tube 16, which is disposed in the base flange 15 rotatably and in a reciprocatory condition (in FIG. 4, in a vertically movable condition); and a screw cap 17, which assumes a closed-bottomed tubular shape and is disposed outside the base flange 15 rotatably and in a reciprocatory condition.

The base flange 15, which includes a lower flange portion 13 and an upper tubular portion 14 formed integrally with the flange portion 13, is fixedly attached along an upper peripheral edge of the rupture portion 36.

In the tubular portion 14, a female thread 14A is formed on the inner surface in a region extending from substantially the vertical center to the lower end, and a male thread 14B is formed on the outer surface in a region extending from substantially the vertical center to the upper end. In the movable tube 16, a plurality of ribs 16A are formed on the inner surface at predetermined circumferential pitches and in a vertically extending condition, and a male thread 16B is formed on the outer surface. Each of the ribs 16A is sloped in the circumferential direction of the movable tube 16 to thereby assume a wedge-like cross section. An annular cutting member 38 for cutting the rupture portion 36 is formed at the lower end of the movable tube 16 in a circumferentially extending condition.

The screw cap 17 includes a top wall 21, and a side wall 22 extending downward from the peripheral edge of the top wall 21. A female thread 22A is formed on the inner surface of the side wall 22. In the screw cap 17, a plurality of arms 23 are formed at predetermined positions located radially inward of the side wall 22 in such a manner as to extend downward from the top wall 21 and at the same pitches as those of the ribs 16A so as to correspond to the ribs 16A. In each of the arms 23, a longitudinally extending engagement piece 24 is formed on the radially outward surface at the lateral center, and a rib 25 is formed on the radially inward surface at the lateral center in such a manner as to extend from substantially the longitudinal center to the upper end.

The tubular portion 14 and the movable tube 16 are thread-engaged with each other by means of the female thread 14A and the male thread 16B; the tubular portion 14 and the side wall 22 are thread-engaged with each other by means of the male thread 14B and the female thread 22A; and the movable tube 16 and the arms 23 are engaged together by means of the ribs 16A and the corresponding engagement pieces 24. The female thread 14A and the male thread 16B constitute a first thread engagement portion; the male thread 14B and the female thread 22A constitute a second thread engagement portion; and the rib 16A and the engagement pieces 24 constitute an engagement portion.

The thread direction of the female thread 14A and the male thread 16B is opposite the thread direction of the male thread 14B and the female thread 22A. Specifically, the female thread 14A and the male thread 16B are formed in a first helix direction. In other words, the female thread 14A and the male thread 16B are left-handed threads, which serve as first threads, so that when the male thread 16B is rotated clockwise relative to the female thread 14A, the male thread 16B advances. The male thread 14B and the female thread 22A are formed in a second helix direction. In other words, the male thread 14B and the female thread 22A are right-handed threads, which serve as second threads, so that when the male thread 14B is rotated counterclockwise relative to the female thread 22A, the male thread 14B advances.

In the base flange 15, an annular rib 41 is formed, in a radially outward projecting condition, on the tubular portion 14 at a predetermined position located in the vicinity of the lower end of the tubular portion 14. An annular ring 43 for prevention of tampering is disposed at the lower end of the side wall 22 in such a manner as to be readily separable from the screw cap 17. The outside diameter of the ring 43 is equal to that of the side wall 22; and the inside diameter of the ring 43 is slightly greater than that of the side wall 22. Thus, the wall thickness of the ring 43 is slightly smaller than that of the screw cap 17. An annular stopper 45 is formed at the lower end of the ring 43 in a radially inward projecting condition. The screw cap 17 and the ring 43 are united by means of connection portions 46 formed at a plurality of circumferential positions. In this case, the screw cap 17 and the ring 43 are integrally molded beforehand. However, the screw cap 17 and the ring 43 may be molded as separate members and joined later by spot-fusing.

In the initial state of the cap Cp, rotating the screw cap 17 in the tightening direction (clockwise) causes the screw cap 17 to move downward, since the tubular portion 14 and the side wall 22 are thread-engaged. In association with this, the arms 23 are caused to move downward, so that the ribs 16A and the corresponding engagement pieces 24 are engaged with each other. Subsequently, as the screw cap 17 is rotated, the movable tube 16 is caused to rotate in the same direction. In this case, since the tubular portion 14 and the movable tube 16 are thread-engaged, the movable tube 16 is caused to move upward while being rotated. As a result, the tubular portion 14 is completely accommodated in the screw cap 17, and the movable tube 16 is completely accommodated in the tubular portion 14. At this time, the rib 41 passes over the stopper 45 along the tapered inner circumferential surface of the stopper 45 and is then accommodated in the ring 43 immediately above the stopper 45.

When the screw cap 17 is rotated in the loosening direction (in FIG. 2, in the direction of the arrow A about the axis Ch), the screw cap 17 is moved upward. However, since the rib 41 prevents the stopper 45 of the ring 43 from moving upward, the connection portions 46 are cut. As a result, the ring 43 is separated from the screw cap 17 and held on the side toward the base flange 15 with respect to the rib 41.

Next, as the screw cap 17 is rotated further in the loosening direction, the screw cap 17 is moved further upward. In association with this, the arms 23 are moved upward while the ribs 16A and the corresponding engagement pieces 24 are engaged with each other, so that the movable tube 16 is rotated in the same direction. As the movable tube 16 is rotated in association with rotation of the screw cap 17, the movable tube 16 is caused to move downward, so that the cutting member 38 cuts the rupture portion 36 to thereby unseal the capped container 31.

After the capped container 31 is unsealed, liquid food can be repeatedly poured out by opening and closing the cap Cp.

When the screw cap 17 is rotated in the tightening direction in order to close the cap Cp, the tubular portion 14 and the side wall 22 are thread-engaged, and the screw cap 17 is moved downward. In association with this, the arms 23 are also moved downward. However, since the movable tube 16 has been moved to the lowest position of its movement at the time of unsealing the capped container 31, the ribs 16A and the engagement pieces 24 do not engage together. Accordingly, the rotation of the screw cap 17 does not cause the movable tube 16 to move upward.

Next, the cutting member 38 will be described.

Figure 5:
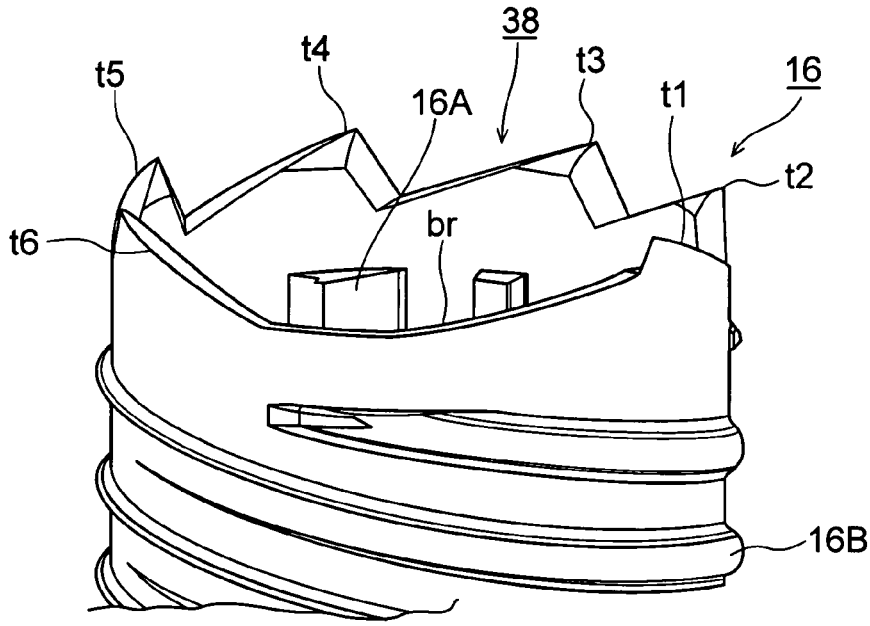
[FIG. 5] Perspective view showing a main portion of a movable tube in the first embodiment of the present invention.
Figure 6:
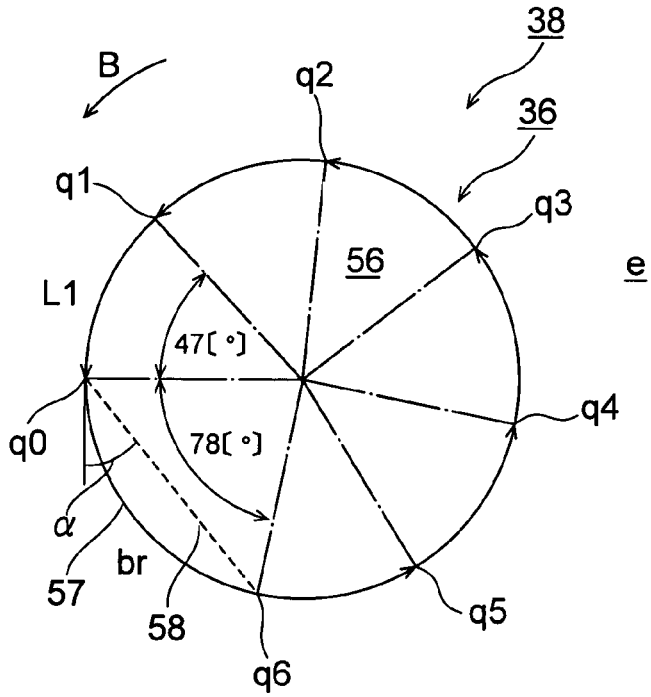
[FIG. 6] View showing a motion of a cutting member in the first embodiment of the present invention.

FIG. 5 is a perspective view showing a main portion of the movable tube in the first embodiment of the present invention; FIG. 6 is a view showing a motion of the cutting member in the first embodiment; and FIG. 7 is a development of the cutting member in the first embodiment.

Figure 7:
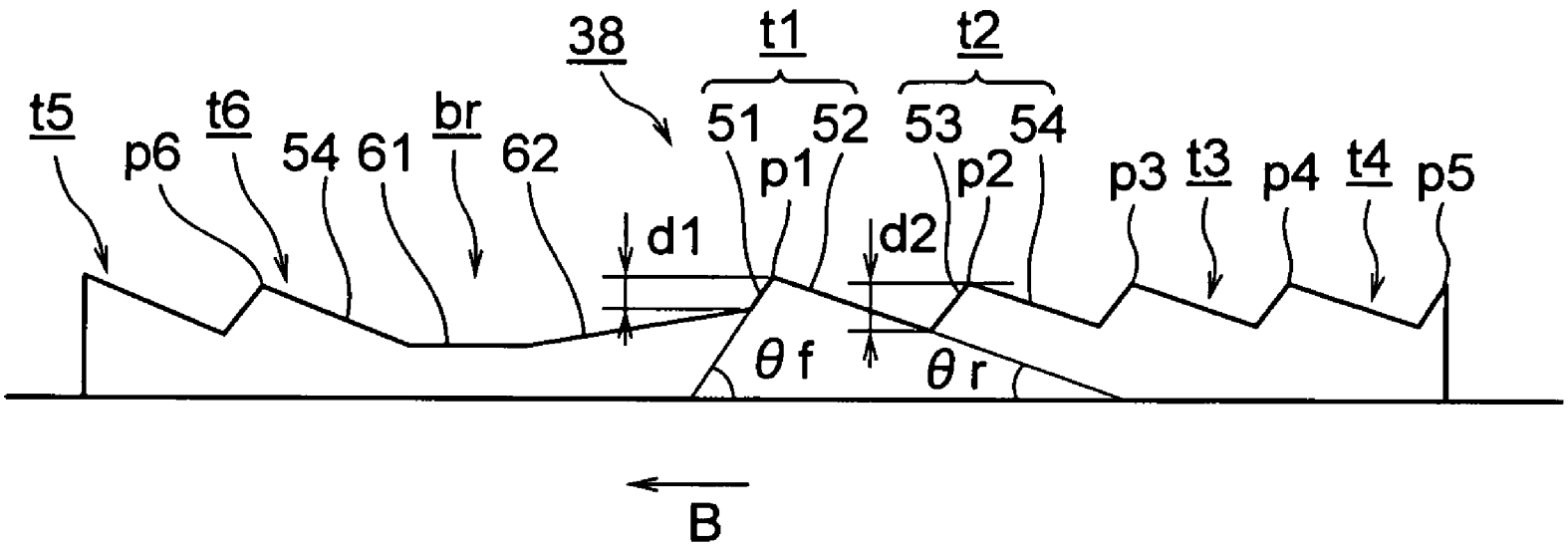
[FIG. 7] Development of the cutting member in the first embodiment of the present invention.

In FIGS. 5 to 7, reference numeral 16 denotes the movable tube. In the movable tube 16, the ribs 16A are formed on the inner surface, and the male thread 16B is formed on the outer surface. The cutting member 38 is formed at the lower end (in FIG. 5, at the upper end) of the movable tube 16 in a circumferentially extending condition. The cutting member 38 includes a plurality of blades; in the present embodiment, six blades t1 to t6, formed over a predetermined range. The blades t1 to t6 are formed continuously over a range of 235[°] and such that their pointed tips p1 to p6 are arranged at equal pitches; specifically, at reference intervals of 47[°] A bottom portion br is formed between two predetermined pointed tips; in the present embodiment, between the pointed tips p1 and p6, in such a manner as to extend over a range wider than the reference interval; specifically, over a range of 125[°]. The bottom portion br includes a trailing cutting edge 54 of the blade t6; a flat portion 61 formed adjacently to the trailing end of the trailing cutting edge 54; a straight edge 62 gradually sloping up from the trailing end of the flat portion 61 to the leading end of a leading cutting edge 51; and the leading cutting edge 51.

When the rotational direction of the movable tube 16 is taken as the direction of the arrow B, the blade t1 includes the leading cutting edge 51, which is a leading sloped portion with respect to the rotational direction of the movable tube 16, and a trailing cutting edge 52, which is a trailing sloped portion with respect to the rotational direction of the movable tube 16; each of the blades t2 to t6 includes a leading cutting edge 53, which is a leading sloped portion, and the trailing cutting edge 54, which is a trailing sloped portion; and an inclination θf of the leading cutting edges 51 and 53 is greater than an inclination θr of the trailing cutting edges 52 and 54. The blade t1 differs in shape from the blades t2 to t6. A depth d1 of the leading cutting edge 51 is less than a depth d2 of the leading cutting edge 53.

When the movable tube 16 is moved downward while being rotated in the direction of the arrow B, the pointed tips p1 to p6 touch points q1 to q6 on the peripheral edge of the rupture portion 36 while being rotated in the direction of the arrow B and form six corresponding holes in the peripheral edge. Subsequently, as the movable tube 16 is rotated further, the peripheral edge of the rupture portion 36 is arcuately cut at six locations. When the movable tube 16 is rotated by about 47[°], the pointed tips p1 to p6 reach points q0 to q5, respectively; and six arcuate cuts are connected. As a result, a continuous arcuate cut line L1 is formed over a range of 282[°] extending from the point q0 to the point q6.

A cut piece 56 is formed at the rupture portion 36 radially inward of the cut line L1. The cut piece 56 is connected to the top wall e over a range of 78[°]. A portion of the peripheral edge of the rupture portion 36 extending over a range of 78[°] becomes an uncut portion 57, which remains connected to the top wall e and holds the cut piece 56.

Incidentally, while the blades t1 to t6 are in the process of cutting the rupture portion 36; i.e., before the six cuts are connected, the cut piece 56 and the top wall e are connected together at portions between the cuts. Thus, the cut piece 56 is not pressed downward and does not lose tension. Therefore, the blades t1 to t6 are not tangled with the cut piece 56.

When the six cuts are connected, the cut piece 56 is separated from the top wall e at the cut line L1 and loses tension. Thus, the cut piece 56 dangles and is pressed downward by the lowering cutting member 38. At this time, depending on the material of the rupture portion 36; i.e., the material of the first and second resin films 34 and 35 (FIG. 3) used to form the rupture portion 36, the cut piece 56 may fail to be bent along a chord 58, thereby failing to dangle. In this case, further rotation of the movable tube 16 potentially causes interference between the first blade t1, and the cut piece 56 and the uncut portion 57.

The results of experiments have revealed that, when an angle α between the chord 58 and the tangent to the cut line L1 is 40[°] or more, further rotation of the movable tube 16 after formation of the cut line L1 causes interference between the first blade t1, and the cut piece 56 and the uncut portion 57. Therefore, preferably, the upper limit of the angle α is set to 40[°]; i.e., an angle α less than 40[°] is employed.

The angle α increases with a range over which the uncut portion 57 is formed. For example, when a range over which the uncut portion 57 is formed is 80[°], the angle α becomes 40[°]. Thus, preferably, the upper limit of a range over which the uncut portion 57 is formed is set to 80[°]; i.e., a range less than 80[°] is employed.

Incidentally, when the movable tube 16 is rotated by one pitch of the arrangement of the pointed tips p1 to p6; in the present embodiment, by 47[°], the cut line L1 is formed, and the cutting of the rupture portion 36 is completed. Subsequently, if further rotation of the movable tube 16 causes the blade t1 to further cut the uncut portion 57, the cut piece 56 will be completely cut away from the top wall e.

In order to avoid the above problem, in the first blade t1, the depth d1 of the leading cutting edge 51 is set to such a value as to enable formation of an arcuate cut only over a range of 47[°]. In this case, the depth d1 is rendered equal to a distance by which the male thread 16B causes the movable tube 16 to move downward while the blade t1 is rotated by 47[°]. In the present embodiment, the depth d1 is set to about 1 [mm].

Accordingly, when the cut line L1 is formed to thereby complete the cutting of the rupture portion 36, the straight edge 62 of the bottom portion br comes into contact with the rupture portion 36. Even when the movable tube 16 is rotated further, the blade t1 does not cut the uncut portion 57, but the cut piece 56 is pressed downward by the straight edge 62.

As described above, the cutting member 38 includes the blades t1 to t6, so that rotating the movable tube 16 causes the blades t1 to t6 to cut the rupture portion 36 at a plurality of locations. Thus, the angle of rotation of the screw cap 17 required for unsealing the capped container 31 can be rendered small.

Since the bottom portion br is formed between the pointed tips p1 and p6 of two blades t1 and t6, the cut piece 56 can be prevented from being completely cut away from the container body 11.

Since a range over which the uncut portion 57 is formed is less than its upper limit, after formation of the cut line L1, interference between the first blade t1, and the cut piece 56 and the uncut portion 57 can be prevented.

Furthermore, the depth d1 of the leading cutting edge 51 of the first blade t1 is limited. Specifically, the depth d1 is rendered equal to a distance by which the movable tube 16 moves while being rotated by one pitch of the arrangement of the blades t1 to t6; i.e., the depth d1 is rendered equal to a lead per pitch. Thus, after formation of the cut line L1, further rotation of the movable tube 16 does not cause the blade t1 to cut the uncut portion 57, but the cut piece 56 is pressed downward by the straight edge 62 of the bottom portion br. Therefore, the outlet 11A having a sufficient area can be formed.

Next, a second embodiment of the present invention will be described.

Figure 8:
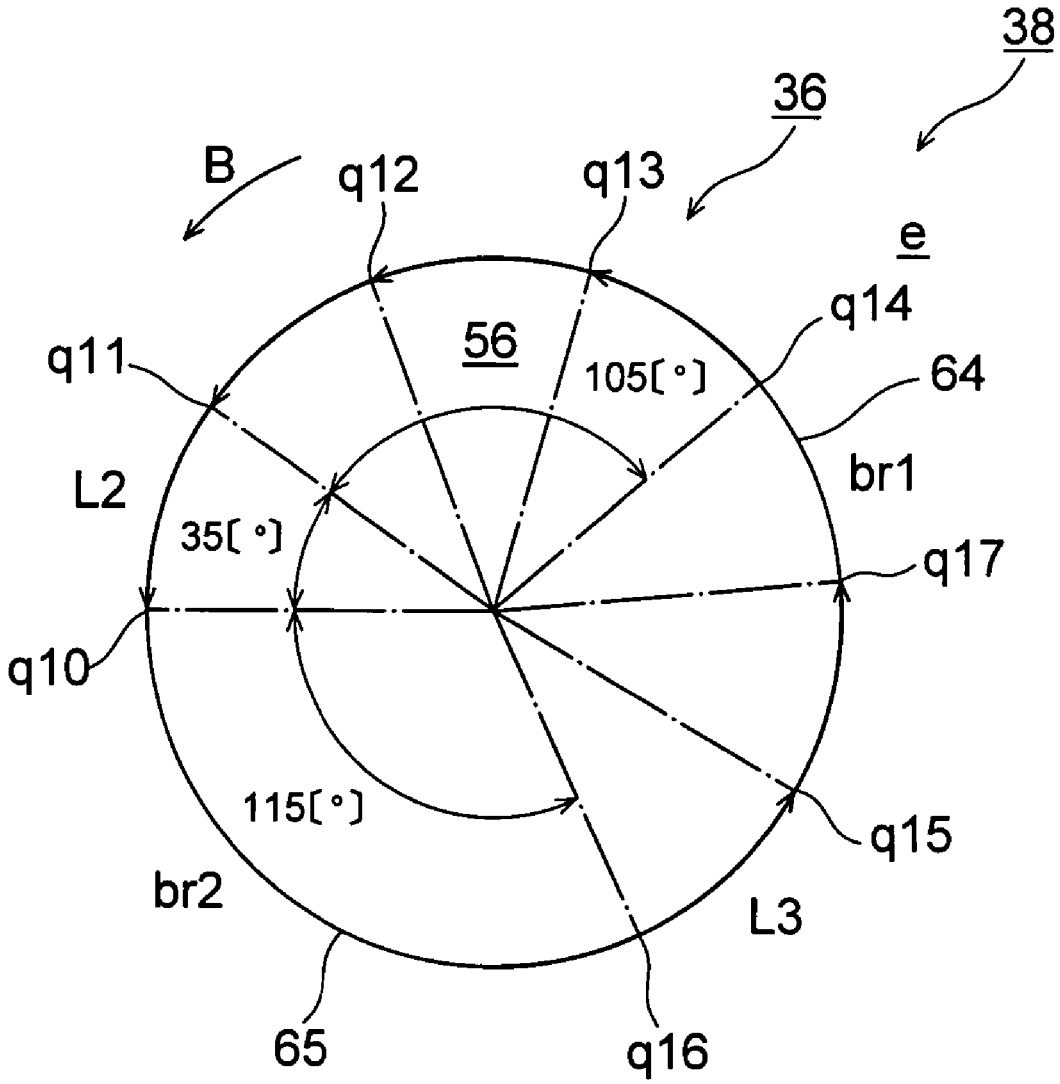
[FIG. 8] View showing a motion of a cutting member in a second embodiment of the present invention.
Figure 9:
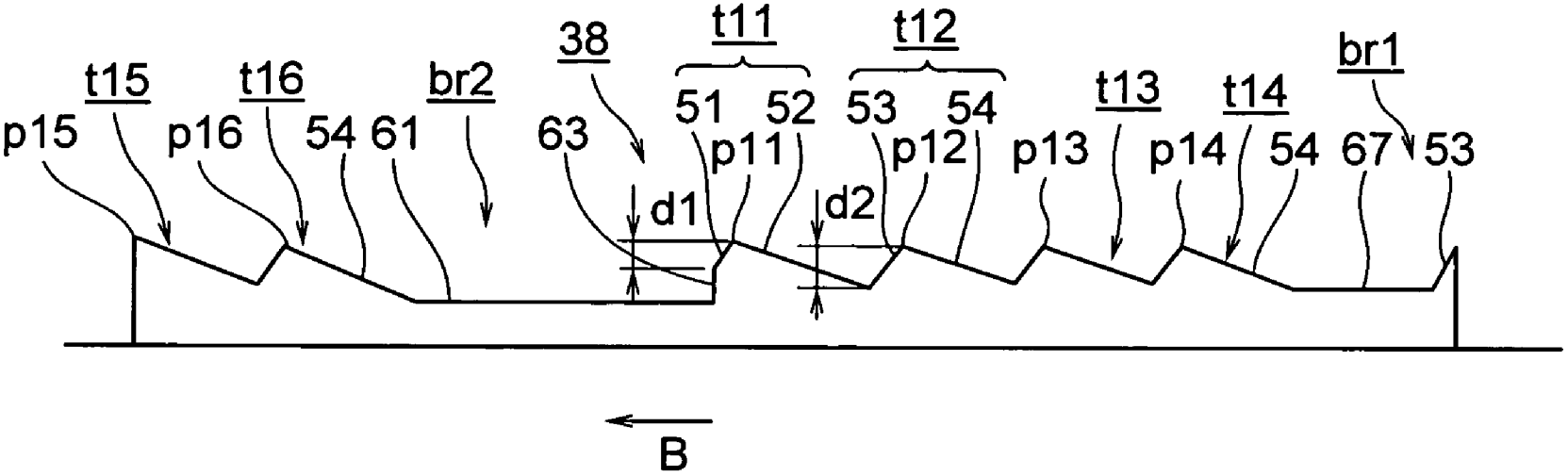
[FIG. 9] Development of the cutting member in the second embodiment of the present invention.

FIG. 8 is a view showing a motion of a cutting member in the second embodiment of the present invention, and FIG. 9 is a development of the cutting member in the second embodiment.

In this case, the cutting member 38 includes a plurality of blades; in the present embodiment, six blades t11 to t16, formed over a predetermined range. The blades t11 to t16 are formed over a range of 210[°] such that their pointed tips p11 to p16 are arranged at equal pitches; specifically, at reference intervals (in the present embodiment, intervals of 35[°]), and such that a first bottom portion br1 is present between the pointed tips p14 and p15. The first bottom portion br1 is formed over a range wider than the reference interval; in the present embodiment, over a range of 70[°]. The first bottom portion br1 includes a trailing cutting edge 54 of the blade t14; a flat portion 67 formed adjacently to the trailing end of the trailing cutting edge 54 and extending to the leading end of a leading cutting edge 53 of the blade t15; and the leading cutting edge 53 of the blade t15. Furthermore, a second bottom portion br2 is formed between the pointed tips p11 and p16 over a range wider than the reference interval; in the present embodiment, over a range of 150[°]. The second bottom portion br2 includes a trailing cutting edge 54 of the blade t16; a flat portion 61 formed adjacently to the trailing end of the trailing cutting edge 54; a straight edge (a vertical portion) 63 formed between the flat portion 61 and a leading cutting edge 51 of the blade t11 and extending downward from a position that is located below the pointed tip p11 of the blade t11 by a distance equal to depth d1; and the leading cutting edge 51.

The first bottom portion br1 serves as an auxiliary bottom portion in relation to the second bottom portion br2. Preferably, the first bottom portion br1 is located on the leading side with respect to a position point-symmetrical to the second bottom portion br2; in the present embodiment, in a range of about 105-175[°] as measured from the pointed tip p11 of the first blade t11.

As in the case of the first embodiment, the blade t11 differs in shape from the blades t12 to t16, and the depth d1 of the leading cutting edge 51 of the blade t11 is less than the depth d2 of the leading cutting edges 53 of the blades t12 to t16.

When the movable tube 16 (FIG. 4) is moved downward while being rotated in the direction of the arrow B, the pointed tips p11 to p16 touch points q11 to q16 on the peripheral edge of the rupture portion 36 while being rotated in the direction of the arrow B and form six corresponding holes in the peripheral edge. Subsequently, as the movable tube 16 is rotated further, the peripheral edge of the rupture portion 36 is arcuately cut at six locations. When the movable tube 16 is rotated by about 35[°], the blades t11 to t16 reach points q10 to q13, q17, and q15, respectively; and six arcuate cuts are connected. As a result, a continuous arcuate cut line L2 is formed over a range of 140[°] extending from the point q10 to the point q14, and a continuous arcuate cut line L3 is formed over a range of 70[°] extending from the point q17 to the point q16.

A cut piece 56 is formed at the rupture portion 36 radially inward of the cut lines L2 and L3. The cut piece 56 is connected to the top wall e over a range of 35[°] corresponding to the first bottom portion br1 and over a range of 115[°] corresponding to the second bottom portion br2. A portion of the peripheral edge of the rupture portion 36 extending over the range corresponding to the first bottom portion brl becomes an uncut portion 64 while remaining connected to the top wall e, whereas a portion of the peripheral edge of the rupture portion 36 extending over the range corresponding to the second bottom portion br2 becomes an uncut portion 65 while remaining connected to the top wall e. The uncut portions 64 and 65 hold the cut piece 56.

Incidentally, while the blades t11 to t16 are in the process of cutting the rupture portion 36; i.e., before the six cuts are connected, the cut piece 56 and the top wall e are connected together at portions between the cuts. Thus, the cut piece 56 is not pressed downward and does not lose tension. Therefore, the blades t11 to t16 are not tangled with the cut piece 56.

Also, when the four cuts formed by the blades t11 to t14 are connected, and the two cuts formed by the blades t15 and t16 are connected, the cut piece 56 is not pressed downward and does not lose tension, since the cut piece 56 and the top wall e are connected together at the uncut portions 64 and 65. Therefore, similarly, the blades t11 to t16 are not tangled with the cut piece 56.

Subsequently, when the movable tube 16 is rotated further by one pitch of the arrangement of the blades t11 to t16; in the present embodiment, by 35[°], the blade t15 cuts the uncut portion 64, thereby forming a continuous arcuate cut line extending between the points q10 and q16 over a range of 245[°]. As a result, the cut piece 56 is separated from the top wall e at the cut line and loses tension. Thus, the cut piece 56 dangles and is pressed downward by the lowering cutting member 38.

Incidentally, in the first blade t11, the depth d1 of the leading cutting edge 51 is set to such a value as to enable formation of an arcuate cut over a range of 35[°]. In this case, the depth d1 is rendered equal to a distance by which the male thread 16B causes the movable tube 16 to move downward while the blade t11 is rotated by 35[°]. In the present embodiment, the depth d1 is set to about 1 [mm].

Accordingly, when the cut lines L2 and L3 are formed, the flat portion 61 of the second bottom portion br2 comes into contact with the rupture portion 36. As mentioned previously, when the movable tube 16 is rotated further so as to cut the uncut portion 64 by means of the blade t15, the blade t11 does not cut the uncut portion 65, but the straight edge 63 crinkles the uncut portion 65 toward the top wall e. Therefore, the outlet 11A (FIG. 4) having a sufficient area can be formed. Also, since, during the process of cutting the uncut portion 64, tension is not lost at the uncut portion 65, the uncut portion 64 can be smoothly cut.

Next, a third embodiment of the present invention will be described.

Figure 10:
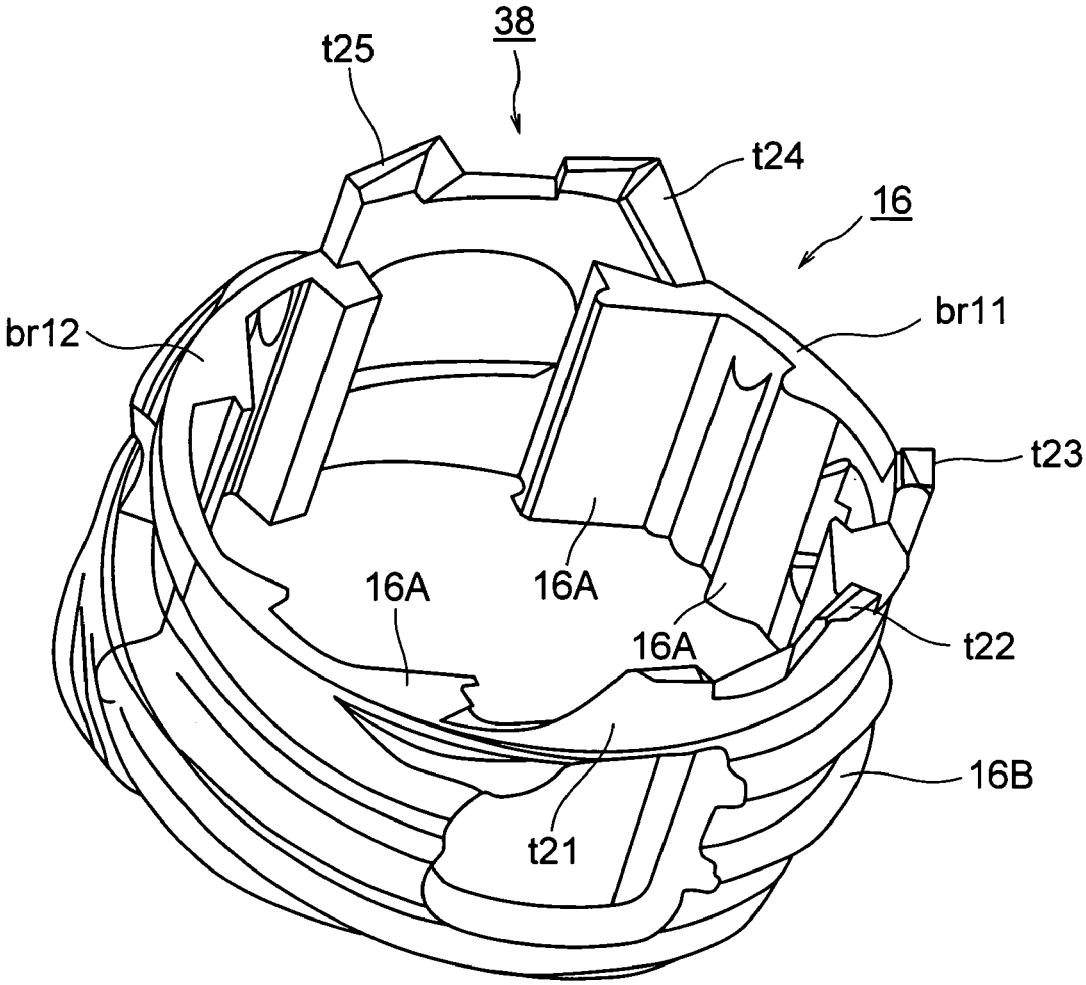
[FIG. 10] Perspective view showing a main portion of a movable tube in a third embodiment of the present invention.
Figure 11:
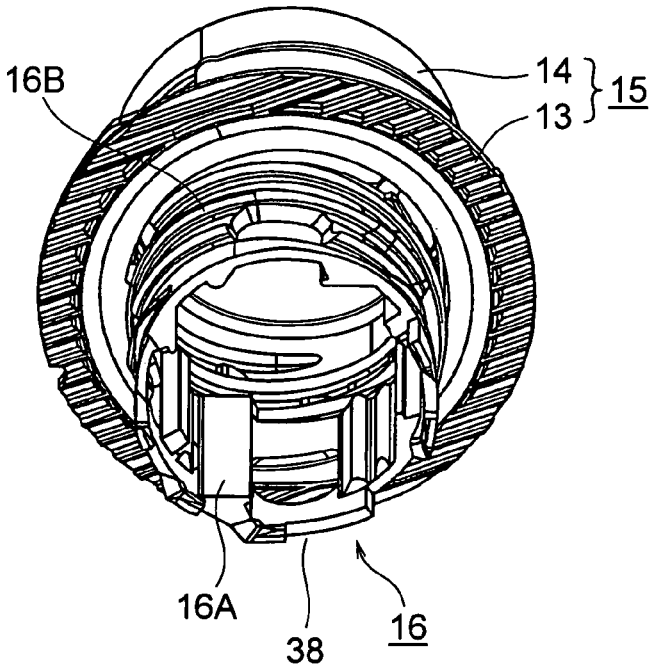
[FIG. 11] Perspective view showing a main portion of a cap in the third embodiment of the present invention.
Figure 12:
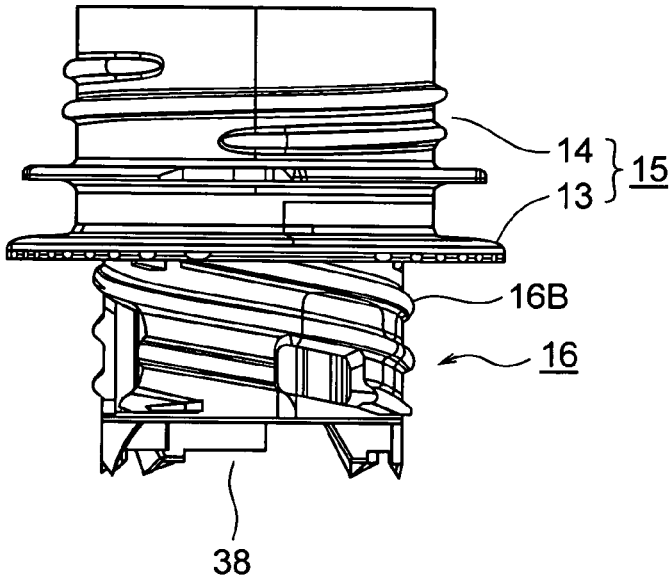
[FIG. 12] View showing a main portion of the cap in the third embodiment of the present invention.
Figure 13:
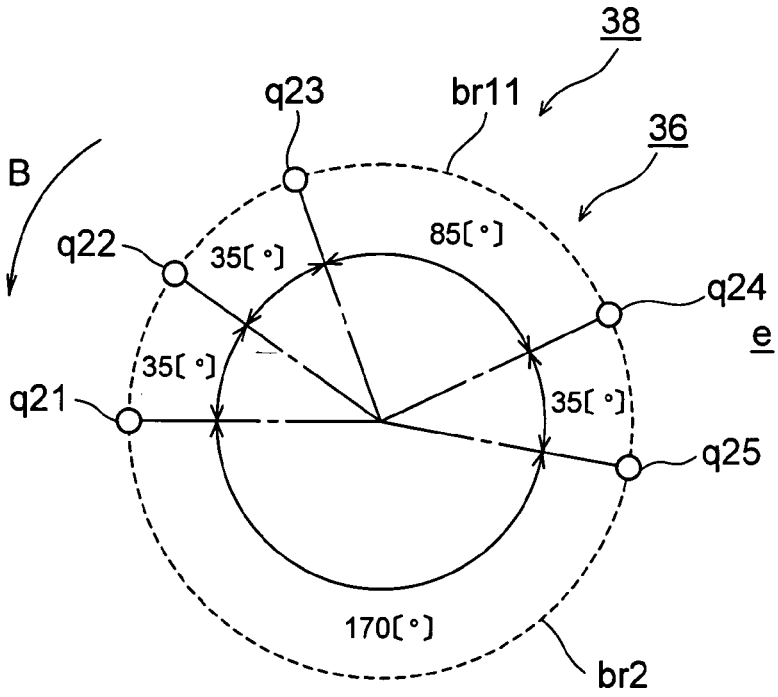
[FIG. 13] First view showing a motion of a cutting member in the third embodiment of the present invention.
Figure 14:
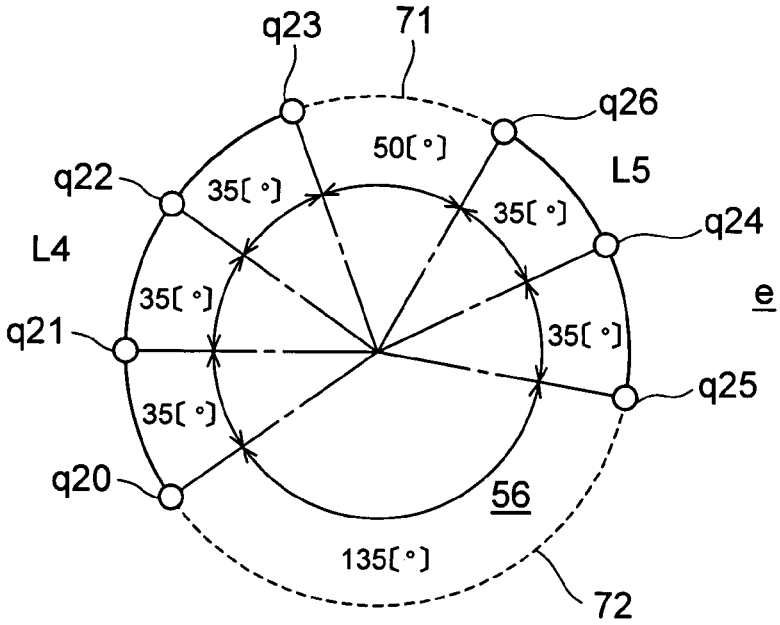
[FIG. 14] Second view showing the motion of the cutting member in the third embodiment of the present invention.
Figure 15:
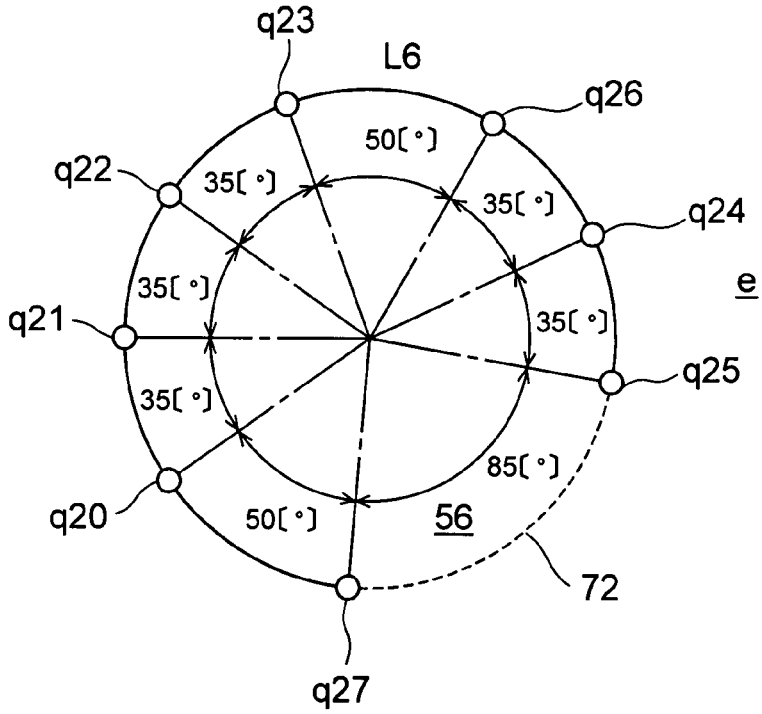
[FIG. 15] Third view showing the motion of the cutting member in the third embodiment of the present invention.
Figure 16:
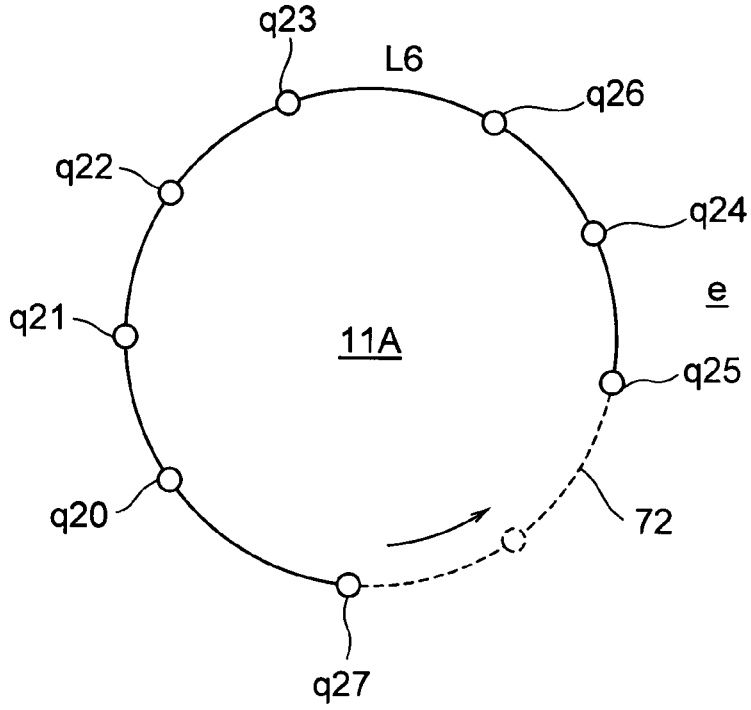
[FIG. 16] Fourth view showing the motion of the cutting member in the third embodiment of the present invention.
Figure 17:
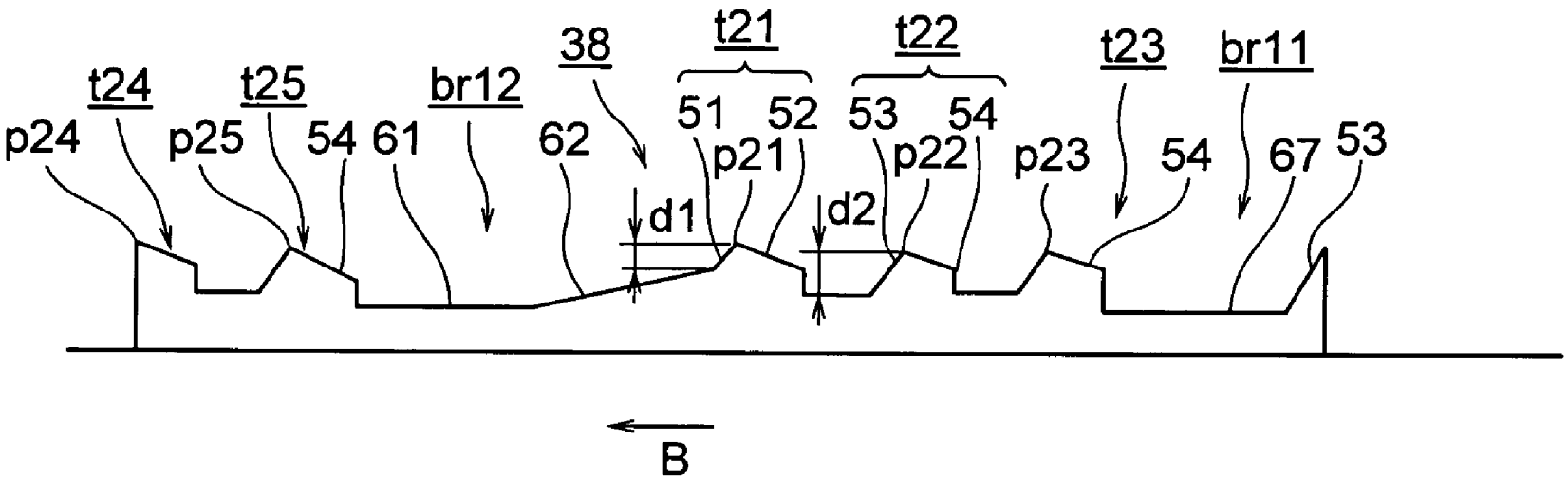
[FIG. 17] Development of the cutting member in the third embodiment of the present invention.

FIG. 10 is a perspective view showing a main portion of the movable tube in the third embodiment of the present invention; FIG. 11 is a perspective view showing a main portion of the cap in the third embodiment; FIG. 12 is a view showing a main portion of the cap in the third embodiment; FIG. 13 is a first view showing a motion of the cutting member in the third embodiment; FIG. 14 is a second view showing the motion of the cutting member in the third embodiment; FIG. 15 is a third view showing the motion of the cutting member in the third embodiment; FIG. 16 is a fourth view showing the motion of the cutting member in the third embodiment; and FIG. 17 is a development of the cutting member in the third embodiment.

In FIGS. 10 to 12, reference numeral 15 denotes the base flange that includes the lower flange portion 13 and the upper tubular portion 14 formed integrally with the flange portion 13; and reference numeral 16 denotes the movable tube. In the movable tube 16, a plurality of ribs 16A are formed on the inner surface at predetermined circumferential pitches and in a vertically extending condition, and the male thread 16B is formed on the outer surface. The annular cutting member 38 for cutting the rupture portion 36 is formed at the lower end of the movable tube 16 in a circumferentially extending condition.

The cutting member 38 includes a plurality of blades; in the present embodiment, five blades t21 to t25, formed over a predetermined range. The blades t21 to t25 are formed over a range of 190[°] such that their pointed tips p21 to p25 are arranged at reference intervals (in the present embodiment, intervals of 35[°]) and such that a first bottom portion br11 is present between the pointed tips p23 and p24. The first bottom portion br11 is formed over a range that is about one or two times the reference interval (over a range of 70-100[°]; in the present embodiment, over a range of 85[°]). The first bottom portion br11 includes a trailing cutting edge 54 of the blade t23; a flat portion 67 formed adjacently to the trailing end of the trailing cutting edge 54 and extending to the leading end of a leading cutting edge 53 of the blade t24; and the leading cutting edge 53 of the blade t24. Furthermore, a second bottom portion br12 is formed between the pointed tips p21 and p25 over a range wider than the reference interval; i.e., over a range of 170[°]. The second bottom portion br12 includes a trailing cutting edge 54 of the blade t25; a flat portion 61 formed adjacently to the trailing end of the trailing cutting edge 54; a straight edge 62 gradually sloping up from the trailing end of the flat portion 61 to the leading end of a leading cutting edge 51 of the blade t21; and the leading cutting edge 51 of the blade 21.

The first bottom portion br11 serves as an auxiliary bottom portion in relation to the second bottom portion br12. The first bottom portion br11 and the second bottom portion br12 are positioned substantially point-symmetrically with respect to the movable cylinder 16. The second bottom portion br12 extends over a wider range than does the first bottom portion br11.

The blade t21 differs in shape from the blades t22 to t25, and the depth d1 of the leading cutting edge 51 of the blade t21 is less than the depth d2 of the leading cutting edges 53 of the blades t22, t23, and t25. The depth of the leading cutting edge 53 of the blade 24 is equal to that of the flat portion 61.

When the movable tube 16 is moved downward while being rotated in the direction of the arrow B, as shown in FIG. 13, the pointed tips p21 to p25 touch points q21 to q25 on the peripheral edge of the rupture portion 36 while being rotated in the direction of the arrow B and form five corresponding holes in the peripheral edge. Subsequently, as the movable tube 16 is rotated and moves downward further, the peripheral edge of the rupture portion 36 is arcuately cut at five locations. When the movable tube 16 is rotated by about 35[°], as shown in FIG. 14, the pointed tips p21 to p25 reach points q20 to q22, q26, and q24, respectively; and five arcuate cuts are connected. As a result, a continuous arcuate cut line L4 is formed over a range of 105[°] extending from the point q20 to the point q23, and a continuous arcuate cut line L5 is formed over a range of 70[°] extending from the point q26 to the point q25.

A cut piece 56 is formed at the rupture portion 36 radially inward of the cut lines L4 and L5. The cut piece 56 is connected to the top wall e over a range corresponding to the first bottom portion br11 and over a range corresponding to the second bottom portion br12. A portion of the peripheral edge of the rupture portion 36 extending over the range corresponding to the first bottom portion br11 becomes an uncut portion 71 while remaining connected to the top wall e, whereas a portion of the peripheral edge of the rupture portion 36 extending over the range corresponding to the second bottom portion br12 becomes an uncut portion 72 while remaining connected to the top wall e. The uncut portions 71 and 72 hold the cup piece 56.

Incidentally, while the blades t21 to t25 are in the process of cutting the rupture portion 36; i.e., before the five cuts are connected, the cut piece 56 and the top wall e are connected together at portions between the cuts. Thus, the cut piece 56 is not pressed downward and does not lose tension. Therefore, the blades t21 to t25 are not tangled with the cut piece 56.

Also, when the three cuts formed by the blades t21 and t23 are connected, and the two cuts formed by the blades t24 and t25 are connected, the cut piece 56 is not pressed downward and does not lose tension, since the cut piece 56 and the top wall e are connected together at the uncut portions 71 and 72, and the uncut portions 71 and 72 are positioned substantially point-symmetrically. Therefore, similarly, the blades t21 to t25 are not tangled with the cut piece 56.

Subsequently, when the movable tube 16 is rotated further by an angle corresponding to the range of the uncut portion 71; in the present embodiment, by 50[°], as shown in FIG. 15, the blade t24 cuts the uncut portion 71, thereby forming a continuous arcuate cut line L6 extending between the points q27 and q25 over a range of 275[°]. As a result, the cut piece 56 is separated from the top wall e at the cut line L6 and loses tension. Thus, the cut piece 56 dangles from the uncut portion 72.

Incidentally, in the first blade t21, the depth d1 of the leading cutting edge 51 is set to such a value as to enable formation of an arcuate cut over a range of 85[°]. In this case, the depth d1 is rendered equal to a distance by which the male thread 16B causes the movable tube 16 to move downward while the blade t21 is rotated by 85[°]. In the present embodiment, the depth d1 is set to about 1 [mm].

Thus, when, after formation of the continuous arcuate cut line L6 over a range extending between the points q27 and q25, the movable tube 16 is rotated further, the blade t21 approaches the uncut portion 72. However, since the cut piece 56 has lost tension and dangles from the uncut portion 72, and a sharp cutting edge portion of the blade t21 is located below the uncut portion 72, the cut piece 56 comes into contact with the straight edge 62, which does not have cutting capability. As a result, as shown in FIG. 16, the straight edge 62 crinkles the uncut portion 72 toward the top wall e, and the outlet 11A is formed.

In the above-described second and third embodiments, only a single auxiliary bottom portion is formed. However, a plurality of auxiliary bottom portions can be formed.

The above embodiments are described while mentioning the first blades t1, t11, and t21 in which the depth d1 of the leading cutting edge 51 is set to such a value that an arcuate cut can be formed by rotating the blade t1, t11, or t21 by the reference interval. However, the depth d2 of the leading cutting edges 53 of the other blades t2 to t6, t12 to t16, t22, t23, and t25 and the depth of the leading cutting edge 53 of the blade 24 can be rendered equal to the depth d1.

The present invention is not limited to the above-described embodiments. Numerous modifications and variations of the present invention are possible in light of the spirit of the present invention, and they are not excluded from the scope of the present invention.

INDUSTRIAL APPLICABILITY

The present invention can be applied to capped containers for containing fluid food.

The invention claimed is:

1. A capped container comprising:

(a) a container body including a wall portion, a cap attachment portion provided at a predetermined position of the wall portion and adapted to attach a cap thereto, and a rupture portion formed at the cap attachment portion;

(b) a tubular base portion attached to the wall portion and surrounding the rupture portion;

(c) a movable tube disposed in the base portion and thread-engaged with the base portion; and (d) a screw cap disposed outside the base portion, thread-engaged with the base portion, engaged with the movable tube, and adapted to rotate the movable tube while being rotated, wherein (e) a cutting member, including a plurality of blades each comprising a leading cutting edge and a trailing cutting edge and adapted to cut the rupture portion as the screw cap is rotated, is formed at a lower end of the movable tube;

(f) first and second bottom portions are formed in the peripheral direction of the cutting member, the first bottom portion formed between pointed tips of first and second blades of the plurality of blades and defining a first interval between the pointed tips of the first and second blades and the second bottom portion formed between pointed tips of the third and fourth blades of the plurality of blades and defining a second interval between pointed tips of the third and fourth blades, wherein the first and second intervals are provided over a range wider than intervals provided between pointed tips of the remaining adjacent blades of the plurality of blades;

(g) the second bottom portion comprises a trailing cutting edge of the third blade; a flat portion formed rearward from the trailing cutting edge; a straight edge gradually sloping up from the trailing end of the flat portion; and a leading cutting edge of the fourth blade; and (h) the depth of the leading cutting edge of the fourth blade in the second bottom portion is less than a depth of a leading cutting edge of the remaining blades of the plurality of blades.

2. A capped container according to claim 1, wherein the first interval between pointed tips of the third blade and the fourth blade in the second bottom portion is formed over a range wider than a reference interval between pointed tips of the remaining adjacent blades of the plurality of blades which do not form the first and second bottom portions.

3. A capped container according to claim 1, wherein one of the first and second bottom portions is formed between the pointed tip of an initial blade and the pointed tip of a last blade in the plurality of blades.

4. A capped container according to claim 1, wherein the second interval is formed over a range wider than the first interval.

5. A capped container according to claim 3, wherein the initial blade differs in shape from other blades.

6. A capped container according to claim 1, wherein a depth of a leading cutting edge of the fourth blade is equal to a distance of downward movement of the movable tube as measured when the movable tube is rotated by a reference interval defined between pointed tips of the remaining adjacent blades which do not form the first and second bottom portions.

* * * * *